United States Patent [19]

White

[11] Patent Number: 4,965,977

[45] Date of Patent: Oct. 30, 1990

[54] INSULATED PANELIZED ROOFING SYSTEM

[76] Inventor: Daniel R. White, 355 E. Las Colinis Blvd., Suite 217, Irving, Tex. 75039

[21] Appl. No.: 479,453

[22] Filed: Feb. 13, 1990

[51] Int. Cl.[5] ..... E04B 5/00

[52] U.S. Cl. ..... 52/410; 52/417; 52/459

[58] Field of Search ..... 52/408, 420, 459, 460, 52/461, 465, 746, 416, 417, 410

[56] References Cited

U.S. PATENT DOCUMENTS

| | | | |
|---|---|---|---|
| 1,578,663 | 3/1926 | Innes | 52/417 |
| 2,626,577 | 1/1953 | Roush et al. | 108/17 |
| 3,095,671 | 7/1956 | Fink et al. | 50/251 |
| 3,153,069 | 6/1964 | Schuller et al. | 50/196 |
| 3,300,927 | 1/1967 | Bettoli | 52/417 X |
| 3,415,029 | 12/1968 | Coletta | 52/419 |
| 3,468,086 | 9/1969 | Warner | 52/746 X |
| 3,892,899 | 7/1975 | Klein | 52/746 X |
| 4,063,395 | 12/1977 | Stewart et al. | 52/417 X |
| 4,107,885 | 8/1978 | Lindal | 52/90 |
| 4,194,335 | 3/1980 | Diamond | 52/419 |
| 4,282,697 | 8/1981 | Spielau et al. | 52/746 |
| 4,393,634 | 7/1983 | McDermott et al. | 52/408 X |
| 4,441,295 | 4/1984 | Kelly | 52/746 X |
| 4,669,246 | 6/1987 | Freeman | 52/408 |
| 4,680,909 | 7/1987 | Stewart | 52/409 |
| 4,738,067 | 4/1988 | Fröseth | 52/478 |
| 4,783,942 | 11/1988 | Nonley et al. | 52/408 X |
| 4,848,057 | 7/1989 | MacDonald et al. | 52/518 |

OTHER PUBLICATIONS

Sales publication distributed by American Roofing Corp. disclosing INSULROOF roof membrane.

Sales publication distributed by Nord Bitumi U.S., Inc. disclosing NORDBOARD.

Sales publication distributed by Wood Fiber Industries, Oct. 1988, disclosing STRUCTODEK FS roofing substrate.

"Prefabricated Panels for Built-Up Roofs," by Lars Runnevik, in 1985: Second International Symposium on Roofing Technology, pp. 481–488.

*Primary Examiner*—Philip C. Kannan

*Attorney, Agent, or Firm*—Richard E. Jenkins

[57] ABSTRACT

A panelized roof system comprises a plurality of panels for positioning on a roof substrate. The panels comprise a foam insulation board with a rubber-modified bitumen-saturated synthetic fiber mat bonded to the top surface thereof. A plurality of fasteners penetrates the sides of the panels and secure the panels to the roof substrate. The panelized roof system is completed and rendered waterproof by a plurality of rubber-modified bitumen-saturated synthetic fiber strips which are applied with hot-mopped asphalt or other non-torched adhesive to the joints between the panels so as to overlap the adjacent fasteners securing the panels to the roof substrate.

37 Claims, 3 Drawing Sheets

INSULATED PANELIZED ROOFING SYSTEM

TECHNICAL FIELD

This invention relates to the art of roofing, and more particularly to the application of protective outer surfaces on commercial roofs.

BACKGROUND ART

As is well known to those skilled in the roofing art, the three leading generic types of commercial low-slope roof constructions are the torched on single-ply roof, the EPDM single-ply roof, and the built-up roof (BUR) construction. Generally speaking, the torched on single-ply roof construction comprises applying an insulation board cover to a steel deck or other suitable roof substrate and then securing an asphalt-coated polyester mat to the insulation boards by utilizing a hot torch flame to heat the underside of the membrane prior to adhering it to the insulation. The EPDM single-ply construction is very similar except that the thin EPDM safety due to the requirement for openflame torches, labor-intensive roof installation requirement, heavy and unwieldy roll roofing materials, splitting and blistering of the roof membrane, lap and seam failures, lack of puncture and tear resistance, failure in high winds, and non-uniform material qualities. In an effort to overcome some of these problems which have long plagued the commercial roofing industry, the panelized roofing system was developed. Quite a number of panelized roof systems are now known and they vary substantially in both their construction features and performance capabilities Representative panelized roofing systems include the STRUCTODEK FS manufactured by Wood Fiber Industries of Chicago, Illinois, the NORD BOARD system distributed by Nord Bitumi of Springfield, N.J., the INSULROOF distributed by American Roofing Corporation of Countryside, Ill., the panelized roofing system distributed by AB Mataki of Sweden, and panel systems disclosed in Stuart U.S. Pat. No. 4,680,909 and Froseth U.S. Pat. No. 4,738,067. However, although potentially an improvement over conventional roofing systems, the panelized roofing systems have suffered from numerous shortcomings including relatively high cost, difficulty in cutting the panel boards, the requirement of open-torch flame application, easily damaged insulation boards, and physical irritation caused by fiberglass or rock wool insulation materials.

Thus, an inexpensive and easy-to-install panelized roofing system has yet to be developed for the commercial roofing industry, and a long-felt need exists for such a roofing system.

DISCLOSURE OF THE INVENTION

In accordance with the present invention, applicant provides an improved panelized roof system construction for application over a roof substrate comprising a plurality of roof panels which are positioned on the substrate in abutting relationship so as to cover the top surface thereof. The panels are formed from a foam insulation board having a synthetic fiber mat which is saturated with bituminous material, preferably rubber-modified, and bonded to the top surface of the board so as to render the foam insulation board substantially waterproof. The mat may be saturated with the bituminous material either before or after bonding to the insulation board. Fasteners are positioned along the sides of the panels and closely adjacent to the joints formed between the abutting panels with the fasteners penetrating the panels so as to secure them to the roof substrate therebeneath. Synthetic fiber strips saturated with bituminous material, preferably rubber-modified, are applied with hot-mopped asphalt or other suitable non-torched adhesive so as to overlap both the joints between the panels and the fasteners adjacent to the edges thereof and to form a water-tight seal thereover. Optionally, the waterproof panelized roof system described hereinabove can be further provided with a hot-mop applied bitumen layer thereover and a suitable surface ply layer then applied over the hot-mop applied bitumen layer. Suitable surface ply layers include bitumen-saturated polyester mat, bitumen-saturated fiberglass mat, modified bitumen cap membrane and granular surface fiberglass cap membrane. Additional top surfacings applied in the field include but are not limited to gravel, ceramic granules, pavers and reflective roof coatings.

Thus, a panelized roof system is provided which can be easily and safely installed and possesses enhanced performance characteristics.

It is therefore the object of this invention to provide an improved panelized roof system which is less labor-intensive than roofing systems known heretofore.

It is another object of the present invention to provide a panelized roof system which does not require use of open-torching on the roof and thereby reduces the exposure of roof workers to hot materials and the heating equipment therefor which would normally be maintained on the roof.

It is another object of the present invention to provide a panelized roof system which results in reduced application problems such as blistering, fishmouths and wrinkles and which may be easily flashed as required.

It is yet another object of the present invention to provide a panelized roofing system which possesses inherent high elongation, flexion, puncture and tear resistance tensile characteristics and which is lightweight and easily fashioned around roof projections and irregularities.

Some of the objects of the invention having been stated, other objects will become evident as the description proceeds, when taken in connection with the accompanying drawings.

BEST MODE FOR CARRYING OUT THE INVENTION

Figure 1:
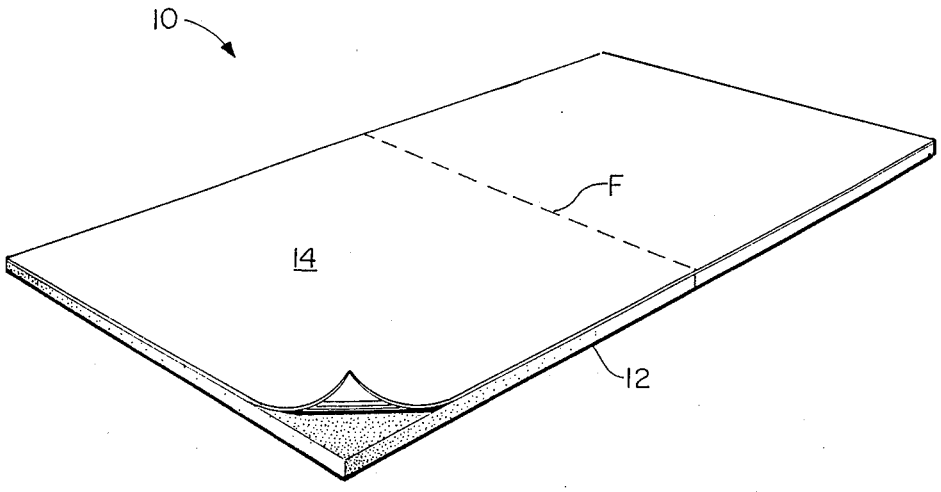
FIG. 1 is a perspective view of a panel according to the present invention.
Figure 2:
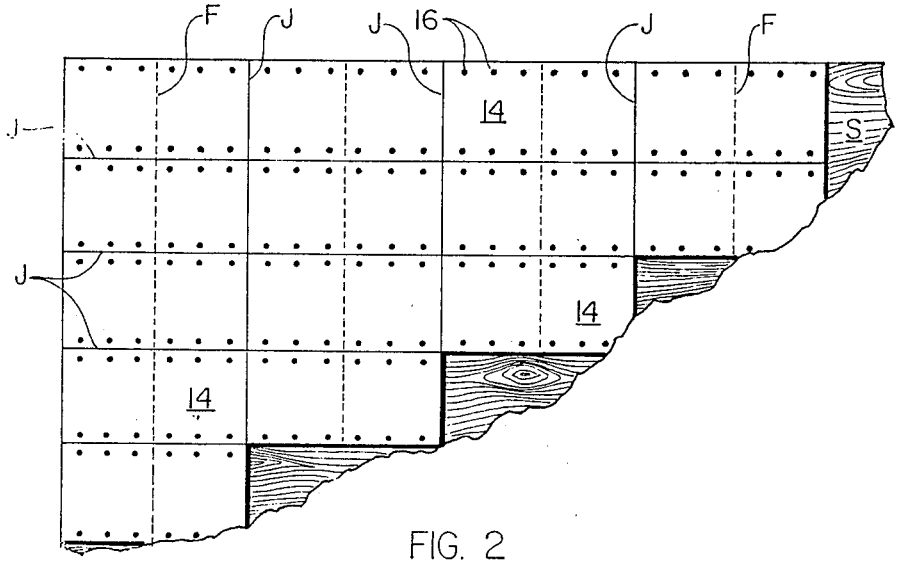
FIG. 2 is a top view of a roof substrate with panels secured thereto in accordance with the present invention.
Figure 3:
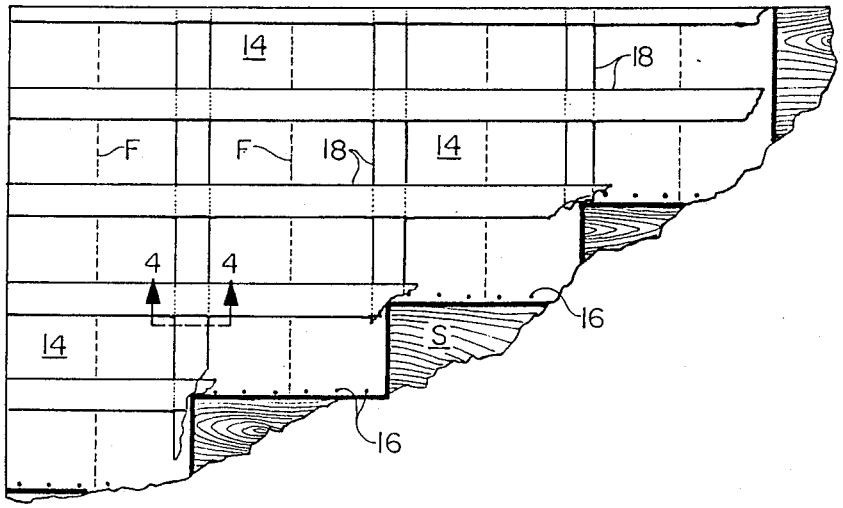
FIG. 3 is a top view of a roof substrate with the roof panels secured thereto and the seams between abutting panels taped according to the present invention.
Figure 4:
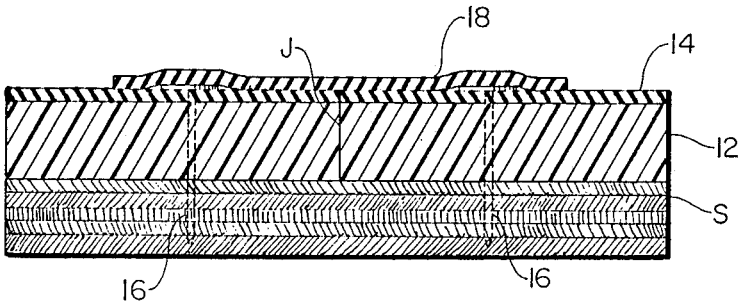
FIG. 4 is a cross-sectional view taken along lines 4—4 of FIG. 3.
Figure 5:
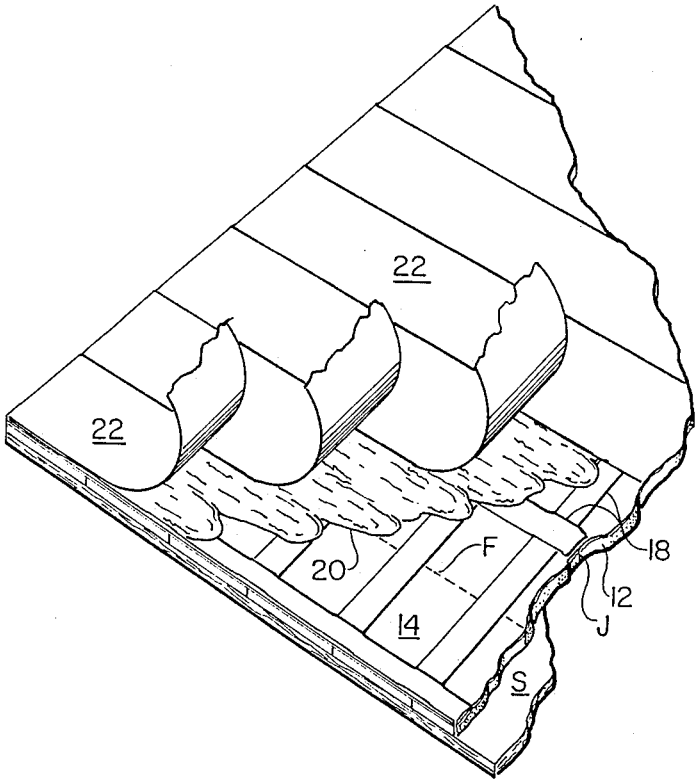
FIG. 5 is a top perspective view of the panelized roof system shown in FIG. 4 with an optional layer of hot-mop applied bitumen and a surface ply layer applied thereon for additional waterproofing of the panelized roof system.

Referring now to the drawings, FIG. 1 shows a panel 10 made in accordance with the present invention. Panel 10 comprises a foam insulation board 12 with a synthetic fiber mat 14 bonded to the top surface thereof. Synthetic fiber mat 14 is saturated with a bitumen material so as to render foam insulation board 12 substantially waterproof. The bitumen material most suitably is polymer-modified (including APP and SBS) bitumen, preferably rubber-modified bitumen, although the use of conventional bitumen is also contemplated by the invention. As a matter of choice, panel 10 may be formed from two sections of foam insulation board 12, which are joined together by synthetic fiber mat 14 which extends across and is bonded to the top surface of both sections of foam insulation board 12 to form a fold line F. Thus, foam insulation board 12 may be folded back upon itself for ease of transportation and installation. The primary advantage of this construction, however, is that the amount of taping is greatly reduced. This optional feature will be discussed in more detail below.

It is presently contemplated that foam insulation board 12 may be a polyisocyanurate foam insulation board, phenolic foam insulation board, extruded polystyrene board, expanded polystyrene (EPS) board, or a urethane board, although most suitably polyisocyanurate and phenolic insulation board are the preferred materials for the panelized roof system of the invention. Although other materials are contemplated as within the scope of the invention, synthetic fiber mat 14 most suitably is formed from either polyester, polyamide, polypropylene, and KEVLAR® fibers or combinations thereof, and the preferred fiber is polyester int he form of a spunbonded non-woven sheet material such as LUTRADUR® manufactured by Feudenberg Spunweb Company of Durham, N.C. Also, although other panel fabrication techniques are possible, most suitably synthetic fiber mat 14 is laminated to foam insulation board 12 during the process of extruding the board, and rubber-modified bitumen (e.g., asphalt-modified with SBS rubber) is then applied to the top surface of synthetic fiber mat 14 at a temperature ranging between about 325° to 400° F.

Panel 10 most suitably comprises a 4×8 foot section of foam insulation board 12 about ½ to 1 inch thick although it is contemplated that panel 10 may range in size from about 4×8 feet to 4×20 feet. If panel 10 is provided with a fold line F in the medial portion thereof, folded foam panels 10 may range in size from 4×4 feet to 4×10 feet. Synthetic fiber mat 14 is most suitably formed from a spunbond or needle punch material weighing between about 3 to 12 ounces per square yard and saturated with rubber-modified bitumen applied at the rate of 10 to 90 pounds per 100 square feet of synthetic fiber mat 14. Foam insulation board 12 when bonded to rubber-modified bitumen-saturated synthetic fiber mat 14 forms a roof insulation panel which is itself waterproof without the application of additional layers of bitumen and/or membranes thereon.

Waterproof panels 10 are secured to roof substrate S therebeneath (see FIGS. 2–5) by fasteners 16. Roof concrete-over-steel decks. Applicant contemplates that conventional fasteners known to those skilled in the art should be used to secure panels 10 to roof substrate S and that a minimum of 6 fasteners 16 will be required for a 4×8 foot panel 10. Most suitably, fasteners 16 will be positioned along the lengthwise sides of panel 10 and penetrate therethrough about 2 inches from the joints J formed by abutting side edges of panels 10. If the roof constructed from the panelized roof system of the present invention is expected to be exposed to unusually high winds, additional fasteners may be placed in the center of panel 10 to secure it to roof substrate S and protect panels 10 from the wind forces. Normally, however, applicant contemplates that fasteners 16 will only have to be secured adjacent to the two lengthwise sides of panels 10 to safely secure the panelized roof system to the underlying roof substrate S.

After panels 10 have been secured to roof substrate S with fasteners 16 as described hereinabove, the joints J defined between abutting panels 10 are taped with synthetic fiber strip 18 which is most suitably about 8 inches in width so as to cover both joints J and fasteners 16 on each side of the joints. To apply synthetic fiber strips 18, the joints J to be covered are first hot-mopped with hot asphalt or other suitable non-torched hot or cold adhesive (not shown). Then synthetic fiber strips 18 are applied over the hot asphalt as shown in FIGS. 2–5 in order to adhere strips 18 over joints J defined between panels 10 and fasteners 16 adjacent to the edges of abutting panels 10. Synthetic fiber strips 18 most suitably are a woven or non-woven sheet formed from polyester, polyamide, polypropylene, or KEVLAR® fibers and mixtures thereof, and most preferably comprise a spunbonded polyester web such as LUTRADUR® manufactured by Freudenberg Spunweb Company of Durham, N.C.

Synthetic fiber strips 18 are saturated during fabrication with a bitumen so as to render them waterproof, and have a thickness of about 20 to 50 mils. The bitumen material most suitably is polymer-modified (including APP and SBS) bitumen, preferably rubber-modified bitumen, although the use of conventional bitumen is also contemplated by the invention. Once rubber-modified bitumen-saturated fiber strips 18 are applied to joints J between abutting panels 10 which have been mopped with hot bitumen, strips 18 adhere to the bitumen and form a waterproof seal over joints J between abutting panels 10 as well as fasteners 16 securing panels 10 to underlying roof substrate S (see FIG. 4). The panelized roof system as now described is waterproof, and no further layers are required in most circumstances.

Optionally, however, the panelized roof system described above may be hot-mopped with bitumen layer 20 over panels 10 and synthetic fiber strips 18, and a suitable surface ply layer 22 then placed on the hot asphalt in order to provide enhanced waterproofing performance capability to the novel panelized roof system. Although substantially any conventional surface ply layer may be applied over the hot-mopped bitumen, representative surface ply layers include bitumen-saturated polyester mat, bitumen-saturated fiberglass mat, rubber or plastic modified bitumen cap membrane and granular surface fiberglass cap membrane.

It will thus be seen that there has been described above an improved panelized roof system which provides for a high-performance panelized roof system which is safer and easier to install than any roofing system known heretofore. Additionally, as an optional feature, each panel may be constructed so as to be easily folded back upon itself about a medial transverse fold line in order to facilitate transportation and installation of the panel.

It will be understood that various details of the invention may be changed without departing from the scope of the invention. Furthermore, the foregoing description is for the purpose of illustration only, and not for the purpose of limitation—the invention being defined by the claims.

What is claimed is:

1. A panelized roof system construction for application over a roof substrate comprising:

a plurality of panels positioned on said substrate in abutting relationship so as to form joints therebetween and substantially cover the top surface of said substrate, said panels comprising a foam insulation board having a synthetic fiber mat bonded to the top surface thereof, said synthetic fiber mat being saturated with bituminous material so as to render said foam insulation board substantially waterproof;

a plurality of fasteners positioned in spaced-apart relationship along at least two sides of each of said panels and adjacent to said joints, said fasteners penetrating the panels so as to secure said panels to said roof substrate; and a plurality of bitumen-saturated synthetic fiber strips being applied with hot-mopped asphalt or other suitable non-torched adhesive so as to overlap both said joints between said panels and any of said fasteners positioned adjacent thereto.

2. A panelized roof system construction according to claim 1 wherein said panels are between about 4×8 feet and 4×20 feet in size.

3. A panelized roof system construction according to claim 1 wherein said panels each comprise two foam insulation boards joined together by said synthetic fiber mat bonded to the top thereof, said mat serving as a hinge so that said two foam insulation boards can be folded together in overlaying relationship.

4. A panelized roof system construction according to claim 1 wherein said foam insulation board is selected from the group consisting of polyisocyanurate board, phenolic board, extruded polystyrene board, expanded polystyrene board and urethane board.

5. A panelized roof system construction according to claim 1 wherein said synthetic fiber mat comprises a spunbonded non-woven sheet having a weight between about 3–12 ounces/square yard, and constructed of fibers selected from the group consisting of polyester, polyamide, polypropylene, KEVLAR ®, and mixtures thereof.

6. A panelized roof system construction according to claim 5 wherein said synthetic fiber mat is saturated with about 10–90 pounds of rubber-modified bituminous material for 100 square feet of said mat.

7. A panelized roof system construction according to claim 1 wherein said plurality of fasteners comprises a plurality of fasteners positioned about 2 inches from the sides of said panels.

8. A panelized roof system construction according to claim 1 wherein said synthetic fiber strips comprise a spunbonded non-woven sheet formed from fibers selected from the group consisting of polyester, polyamide, polypropylene, KEVLAR ® and mixtures thereof.

9. A panelized roof system construction according to claim 8 wherein said synthetic fiber strips are between about 20–50 mils thick and are saturated with rubber-modified bitumen.

10. A panelized roof system construction according to claim 8 wherein said synthetic fiber strips are about 8 inches in width.

11. A panelized roof system construction according to claim 1 wherein said panelized roof system construction further includes a hot-mop applied bitumen layer applied over said plurality of panels and bitumen-saturated fiber strips and a surface ply layer applied

12. A panelized roof system construction according to claim 11 wherein said surface ply layer comprises one or more bitumen-saturated polyester mats.

13. A panelized roof system construction according to claim 11 wherein said surface ply layer comprises one or more bitumen-saturated fiberglass mats.

14. A panelized roof system construction according to claim 11 wherein said surface ply layer comprises a modified bitumen cap membrane.

15. A panelized roof system construction according to claim 11 wherein said surface ply layer comprises a granular surface fiberglass cap membrane.

16. A panelized roof system construction for application over a roof substrate comprising:

a plurality of panels positioned on said substrate in abutting relationship so as to form joints therebetween and substantially cover the top surface of said substrate, said panels comprising a foam insulation board selected from the group consisting of polyisocyanurate board, phenolic board, extruded polystyrene board expanded polystyrene board and urethane board and having a synthetic fiber mat bonded to the top surface thereof, said synthetic fiber mat being a spunbonded non-woven sheet constructed of fibers selected from the group consisting of polyester, polyamide, polypropylene, KEVLAR ®, and mixtures thereof saturated with polymer-modified bituminous material so as to render said foam insulation board substantially waterproof;

a plurality of fasteners positioned in spaced-apart relationship along at least two sides of each of said panels and adjacent to said joints, said fasteners penetrating the panels so as to secure said panels to said roof substrate; and a plurality of polymer-modified bitumen-saturated synthetic fiber strips, said saturated strips comprising a spunbonded non-woven sheet of fibers selected from the group consisting of polyester, polyamide, polypropylene, KEVLAR ®, and mixtures thereof being applied with hotmopped asphalt or other suitable non-torched adhesive so as to overlap both said joints between said panels and any of said fasteners positioned adjacent thereto.

17. A panelized roof system construction according to claim 16 wherein said panels are between about 4×8 feet and 4×20 feet in size.

18. A panelized roof system construction according to claim 16 wherein said panels each comprise two foam insulation boards joined together by said synthetic fiber mat bonded to the top thereof, said mat serving as a hinge so that said two foam insulation boards can be folded together in overlaying relationship.

19. A panelized roof system construction according to claim 16 wherein aid synthetic fiber mat has a weight between about 3–12 ounces/square yard.

20. A panelized roof system construction according to claim 16 wherein said synthetic fiber mat is saturated with about 10–90 pounds of rubber-modified bituminous material for 100 square feet of said mat.

21. A panelized roof system construction according to claim 16 wherein said plurality of fasteners comprises a plurality of fasteners positioned about 2 inches from the sides of said panels.

22. A panelized roof system construction according to claim 16 wherein said synthetic fiber strips are between about 20–50 mils thick and saturated with rubber-modified bitumen.

23. A panelized roof system construction according to claim 16 wherein said synthetic fiber strips are about 8 inches in width.

24. A panelized roof system construction according to claim 16 wherein said panelized roof system construction further includes a hot-mop applied bitumen layer applied over said plurality of panels and bitumen-saturated fiber strips and a surface ply layer applied over said bitumen layer.

25. A panelized roof system construction according to claim 24 wherein said surface ply layer comprises one or more bitumen-saturated polyester mats.

26. A panelized roof system construction according to claim 24 wherein said surface ply layer comprises one or more bitumen-saturated fiberglass mats.

27. A panelized roof system construction according to claim 24 wherein said surface ply layer comprises a modified bitumen cap membrane.

28. A panelized roof system construction according to claim 24 wherein said surface ply layer comprises a granular surface fiberglass cap membrane.

29. A panelized roof system construction for application over a roof substrate comprising:

a plurality of panels positioned on said substrate in abutting relationship so as to form joints therebetween and substantially cover the top surface of said substrate, said panels comprising a polyisocyanurate foam insulation board having a spunbonded non-woven polyester mat bonded to the top surface thereof, said mat weighing between about 3–12 ounces/square yard - and being saturated with about 10–90 pounds of rubber-modified bituminous material for 100 square feet of mat so as to render said foam insulation board substantially waterproof;

a plurality of fasteners positioned in spaced-apart relationship along at least two sides of each of said panels and adjacent to said joints, said fasteners penetrating the panels so as to secure said panels to said roof substrate; and a plurality of rubber-modified bitumen-saturated spunbonded non-woven polyester strips about 20–50 mils thick and being applied with hot-mopped asphalt so as to overlap both said joints between said panels and any of said fasteners positioned adjacent thereto.

30. A panelized roof system construction according to claim 29 wherein said panels are between about 4×8 feet and 4×20 feet in size.

31. A panelized roof system construction according to claim 29 wherein said panels each comprise two foam insulation boards joined together by said synthetic fiber mat bonded to the top thereof, said mat serving as a hinge so that said two foam insulation boards can be folded together in overlaying relationship.

32. A panelized roof system construction according to claim 29 wherein said plurality of fasteners comprises a plurality of fasteners positioned about 2 inches from the sides of said panels.

33. A panelized roof system construction according to claim 29 wherein said panelized roof system construction further includes a hot-mop applied bitumen layer applied over said plurality of panels and bitumen-saturated fiber strips and a surface ply layer applied over said bitumen layer.

34. A panelized roof system construction according to claim 33 wherein said surface ply layer comprises one or more bitumen-saturated polyester mats.

35. A panelized roof system construction according to claim 33 wherein said surface ply layer comprises one or more bitumen-saturated fiberglass mats.

36. A panelized roof system construction according to claim 33 wherein said surface ply layer comprises a modified bitumen cap membrane.

37. A panelized roof system construction according to claim 33 wherein said surface ply layer comprises a granular surface fiberglass cap membrane.

* * * * *

UNITED STATES PATENT AND TRADEMARK OFFICE

CERTIFICATE OF CORRECTION

PATENT NO. : 4,965,977

DATED : October 30, 1990

INVENTOR(S) : Daniel R. White

It is certified that error appears in the above-identified patent and that said Letters Patent is hereby corrected as shown below:

In Column 1, lines 21-22, after "EPDM" and before "safety" please insert --membrane is glued to the insulation boards. Also, ballasting with heavy rock and spot attachment with fasteners are two other methods used to attach the EPDM membrane to the deck. Finally, the BUR roof construction normally provides for applying multiple reinforcement layers of asphalt saturated paper or fiberglass or spunbond polyester with hot-mopped asphalt applied between the layers in order to form a waterproof barrier over the roof substrate.

Unfortunately, all of the roof constructions described above suffer from inherent shortcomings which include lack of--.

In Column 3, line 36, after "polyester" change "int he" to --in the--.

In Column 3, lines 65-66, after "Roof" and before "concrete-over-steel decks" please insert --substrate S may include plywood decks, wood plank decks, steel decks, structural concrete, and poured lightweight--.

Column 6

In Claim 19, line 2, change "aid" to --said--.

Signed and Sealed this

Twenty-sixth Day of January, 1993

*Attest:*

STEPHEN G. KUNIN

*Attesting Officer*

*Acting Commissioner of Patents and Trademarks*